US007674220B2

(12) United States Patent
Howell et al.

(10) Patent No.: US 7,674,220 B2
(45) Date of Patent: Mar. 9, 2010

(54) METHOD AND APPARATUS FOR APPLYING HOT-MELT ADHESIVE TO ZIPPER FLANGES AND APPLYING ZIPPER TO PACKAGES

(75) Inventors: Clifton R. Howell, Buford, GA (US); David C. Wallace, Lilbum, GA (US); Adam N. Caplan, Atlanta, GA (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 11/891,217

(22) Filed: Aug. 9, 2007

(65) Prior Publication Data

US 2009/0042706 A1 Feb. 12, 2009

(51) Int. Cl.
*B31B 1/92* (2006.01)

(52) U.S. Cl. ..... 493/215; 493/381; 493/382; 493/212; 493/213; 493/214; 493/335

(58) Field of Classification Search ..... 493/379–382, 493/210–215, 331, 334–335
See application file for complete search history.

(56) References Cited

U.S. PATENT DOCUMENTS 4,341,575 A * 7/1982 Herz ..... 156/66
4,372,793 A * 2/1983 Herz ..... 156/66
4,601,694 A * 7/1986 Ausnit ..... 493/381
4,620,320 A * 10/1986 Sullivan ..... 383/203
4,691,373 A * 9/1987 Ausnit ..... 383/63
4,812,074 A * 3/1989 Ausnit et al. ..... 493/213
5,709,915 A * 1/1998 Tomic et al. ..... 428/35.2
6,131,370 A * 10/2000 Ausnit ..... 53/412
6,216,423 B1 * 4/2001 Thieman ..... 53/412
7,093,409 B2 * 8/2006 Dutt et al. ..... 53/412
7,197,859 B2 * 4/2007 Knoerzer et al. ..... 53/412

FOREIGN PATENT DOCUMENTS

EP 0 531 701 A 3/1993

* cited by examiner

*Primary Examiner*—Christopher Harmon
(74) *Attorney, Agent, or Firm*—Day Pitney LLP

(57) ABSTRACT

The disclosure relates to a method and apparatus for the attachment of a zipper to a reclosable package or bag, particular packages or bags of relatively larger sizes. Pinch rollers separate the flanges of the zipper so that the interior walls of the flanges are pointing upward, then hot-melt adhesive is sprayed downwardly onto the flanges. The zipper is then guided over the edge of the horizontally-oriented package or bag by a tube with a longitudinal slot. The package or bag, with the zipper attached, is engaged between a driven-belt apparatus with a nip formed between opposed belts, thereby applying consistent and even pressure to the zipper flanges and assuring that the hot-melt adhesive forms a bond which is consistent, reliable and strong.

16 Claims, 5 Drawing Sheets

METHOD AND APPARATUS FOR APPLYING HOT-MELT ADHESIVE TO ZIPPER FLANGES AND APPLYING ZIPPER TO PACKAGES

BACKGROUND OF THE INVENTION

1. Field of the Invention

The present invention pertains to a method and apparatus for applying hot-melt adhesive to zipper flanges and for subsequently applying the zipper to reclosable packages.

2. Description of the Prior Art

In the prior art, reclosable packages and the methods of manufacture thereof, are well-developed and generally satisfactory for their intended purposes. Moreover, the manufacturing methods of larger reclosable packages, that is, of the size typical for charcoal, animal feed, and similar products, have been developed in commonly assigned U.S. patent application Ser. No. 11/728,477 entitled "High Burst Zipper Assembly for Large Reclosable Packages"; U.S. patent application Ser. No. 11/728,405 entitled "Method of Producing High Burst Zipper Assemblies for Large Reclosable Packages" and application Ser. No. 11/728,413 entitled "Hot-melt Adhesive Systems for Zipper Assemblies on Large Bag Constructions of Various Substrates", all filed on Mar. 26, 2007.

However, further improvements are always sought, particularly with respect to a range of package sizes, including those between the typical grocery-sized smaller reclosable packages and the above-described larger reclosable packages.

OBJECTS AND SUMMARY OF THE INVENTION

It is therefore an object of the present invention to provide improvements for reclosable packages and the methods of manufacture thereof.

It is therefore a further object of the present invention to provide these improvements for a range of sizes of reclosable packages.

These and other objects are attained by providing an apparatus and method wherein the zipper is unreeled from a spool with the two flanges together. The interlocking elements of the zipper are captured between a pair of grooved rollers while two sets of pinch rollers separate or spread the two flanges. The zipper, including the separated flanges, is passed over a roller with the interior walls of the flanges facing upwardly. A hot-melt applicator is located over the roller and sprays the hot-melt adhesive downwardly on the interior walls of the zipper flanges. The zipper is then guided over the top of the reclosable package by a tube with a slot cut down its full length. Guides, either with or without vacuum, are used to position the package between the zipper flanges. A wedge guide is then used to lay the zipper flanges to both sides of the horizontally oriented reclosable package. Thereafter, driven pressure belts are used to create highly desirable and uniform surface contact between the zipper flanges, hot-melt adhesive and the reclosable package.

This method is particularly applicable to large reclosable packages made with multi-wall or propylene material. However, this method may be applied to other sizes of reclosable packages, made from different materials.

BRIEF DESCRIPTION OF THE DRAWINGS

Further objects and advantages of the invention will become apparent from the following description and from the accompanying drawings and claims, wherein:

DETAILED DESCRIPTION OF THE PREFERRED EMBODIMENT

Figure 1:
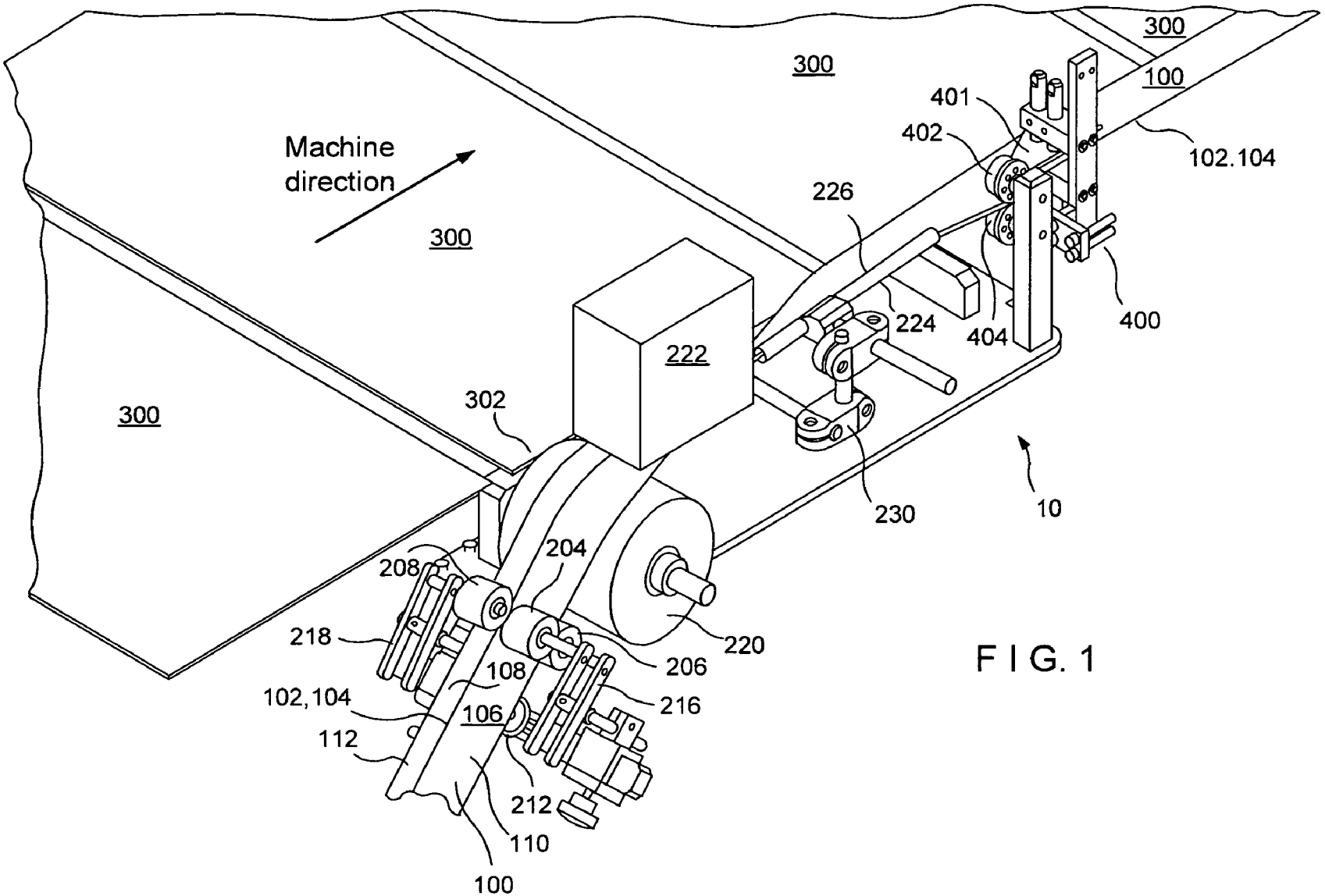
FIG. 1 is a perspective view of the apparatus for applying the hot-melt adhesive to the zipper profile and positioning the zipper profile, with the hot-melt adhesive applied, onto the horizontally oriented reclosable packages.
Figure 2:
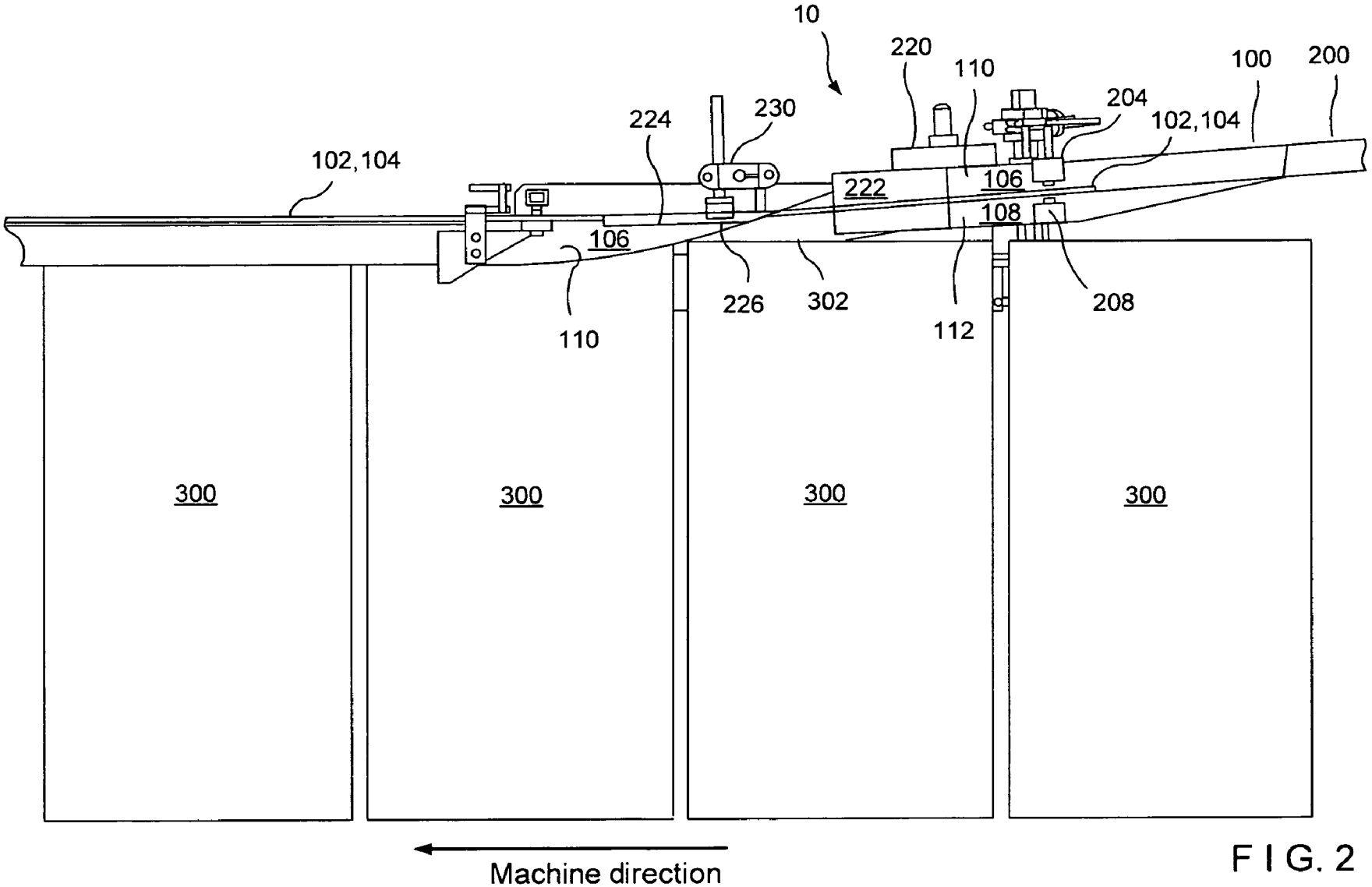
FIG. 2 is an upper plan view of the apparatus of FIG. 1, further disclosing the spool of zipper material, along with the horizontally oriented reclosable packages.
Figure 3:
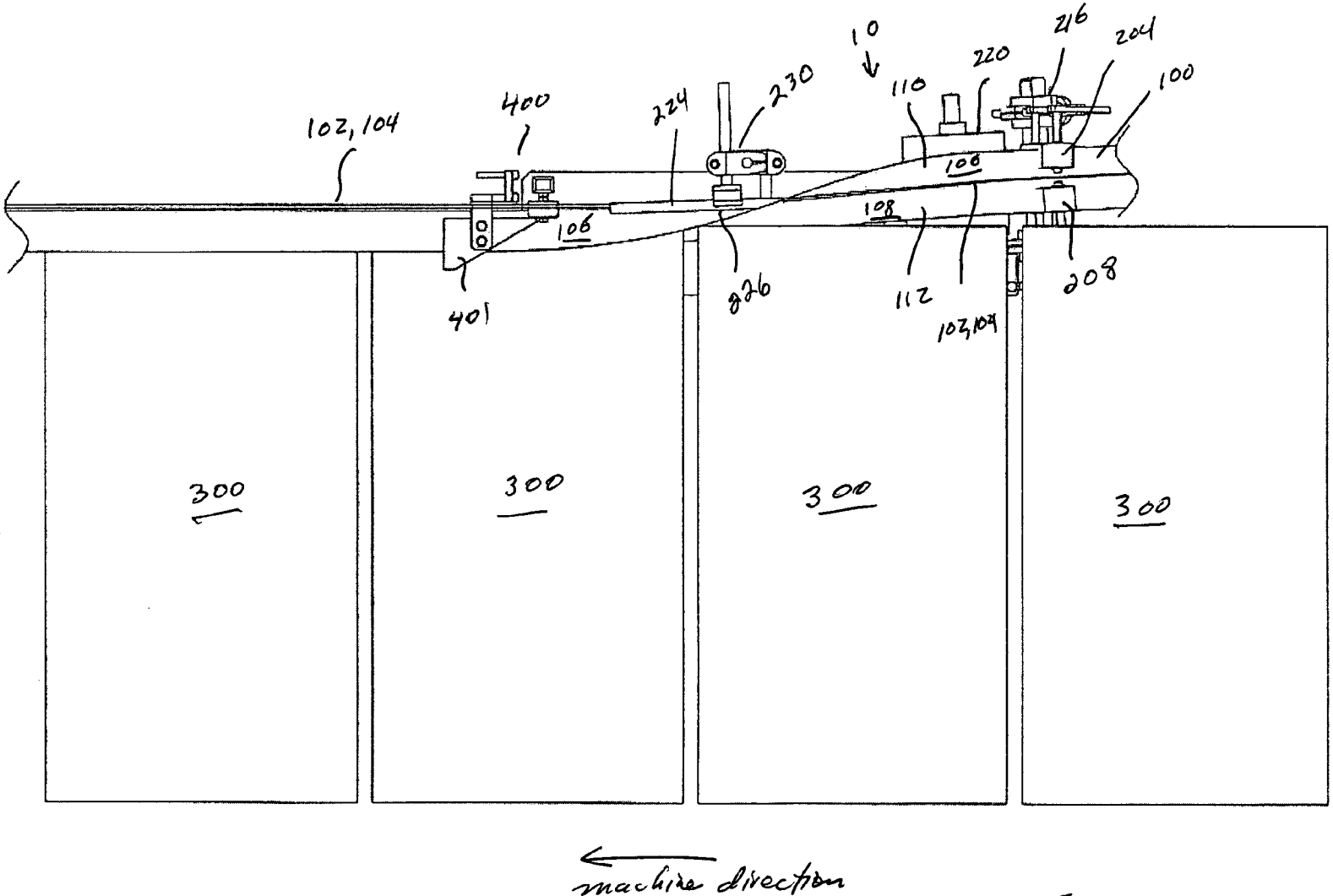
FIG. 3 is an upper plan view similar to that of FIG. 2, shown without the hot-melt adhesive applicator.

Referring now to the drawings in detail, wherein like numerals indicate like elements throughout the several views, one sees that FIGS. 1-3 disclose the apparatus 10 for applying hot-melt adhesive to the zipper flanges.

The zipper 100 is provided as a continuous length of zipper material traveling in the machine direction, at a selected speed, from a spool 200 (not drawn to scale), typically with the first and second interlocking elements 102, 104 of the respective first and second zipper profiles 110, 112 interlocked with each other and with first and second flanges 106, 108 of the respective first and second zipper profiles 110, 112 abutting each other. Spool 200 is unreeled to provide the zipper 100 in the machine direction.

As further shown in FIG. 1, a pair of grooved profile guide rollers 212 (the second profile guide roller being obscured from view) captures and aligns the interlocked first and second interlocking elements 102, 104. At the same time, first pair of opposed pinch rollers 204, 206 engages first flange 106 and second pair of opposed pinch rollers 208 (the second opposed pinch roller being obscured from view in the illustrations) engages second flange 108 so as to separate or spread the first and second flanges 106, 108 substantially 180° from each other, while the first and second interlocking elements 102, 104 remain interlocked with each other. The interior walls of first and second flanges 106, 108 face upwardly and the exterior walls of first and second flanges 106, 108 face downwardly.

First pair of opposed pinch rollers 204, 206 and profile guide roller 212 are mounted on first position adjustment device 216 to adjust and vary the desired position, orientation and alignment of the pinch rollers 204, 206 and profile guide roller 212. Likewise, second pair of opposed pinch rollers 208, 210 and the second (unillustrated) profile guide roller are mounted on second position adjustment device 218 to adjust and vary the desired position, orientation and alignment of the pinch rollers 208, 210 and second (unillustrated) profile guide roller.

Zipper 100, with first and second flanges 106, 108 separated and the interior walls thereof facing upwardly, passes over roller 220 (which may be grooved in order to align the zipper 100) and thereafter passes under hot-melt applicator 222 which sprays hot-melt adhesive downwardly onto the upwardly facing interior walls of first and second flanges 106, 108. The downward spraying of the hot-melt adhesive is envisioned to increase the long-term performance of the nozzle of the hot-melt applicator 222.

It is envisioned that hot-melt applicator 222 could apply any number of hot-melt adhesives, such as would be known to those skilled in the art upon review of this disclosure. However, it is particularly envisioned that hot-melt adhesives such as hot-melt, cross-linkable adhesive (such as hot-melt cross-linkable polyurethane reactive adhesive) would be particularly adapted to this method and apparatus, particularly for larger packages or bags with multi-layer paper or woven polypropylene walls.

Zipper 100, with the hot-melt adhesive applied as described above, passes to guide tube 224. Guide tube 224 includes a tubular interior which captures the interlocked first and second interlocking elements 102, 104 and further includes a longitudinal slot 226 which guides first and second flanges 106, 108 back together and directs the first and second flanges 106, 108 in a direction toward the package 300, thereby capturing the edge 302 of one of series of horizontally oriented packages 300 that are moving (typically continuously) in the machine direction at a speed equal to that of zipper 100. Edge 302 includes an opening or mouth between two walls of material, such as multi-layer paper or woven polypropylene. Edge 302 will form the top of the finished reclosable package, with zipper 100 providing the reclosable characteristics of the mouth thereof. First flange 106 is urged against the top wall (with respect to the horizontal orientation of the package 300 illustrated in FIGS. 1-3) of package 300 while second flange 108 is urged against the bottom wall of package 300. When package 300 is put into its vertical orientation during ordinary usage, the walls will ordinarily be referred to as front and rear walls.

Longitudinal slot 226 may have a width which gradually tapers in order to urge the first and second flanges 106, 108 together smoothly, while decreasing the risk of snagging. Guide tube 224 is mounted on third position adjustment device 230 in order to vary the position, orientation and alignment of guide tube 224. Guides (not shown), with or without vacuum, may be used to position package 300 between the first and second zipper flanges 106, 108.

Figure 4:
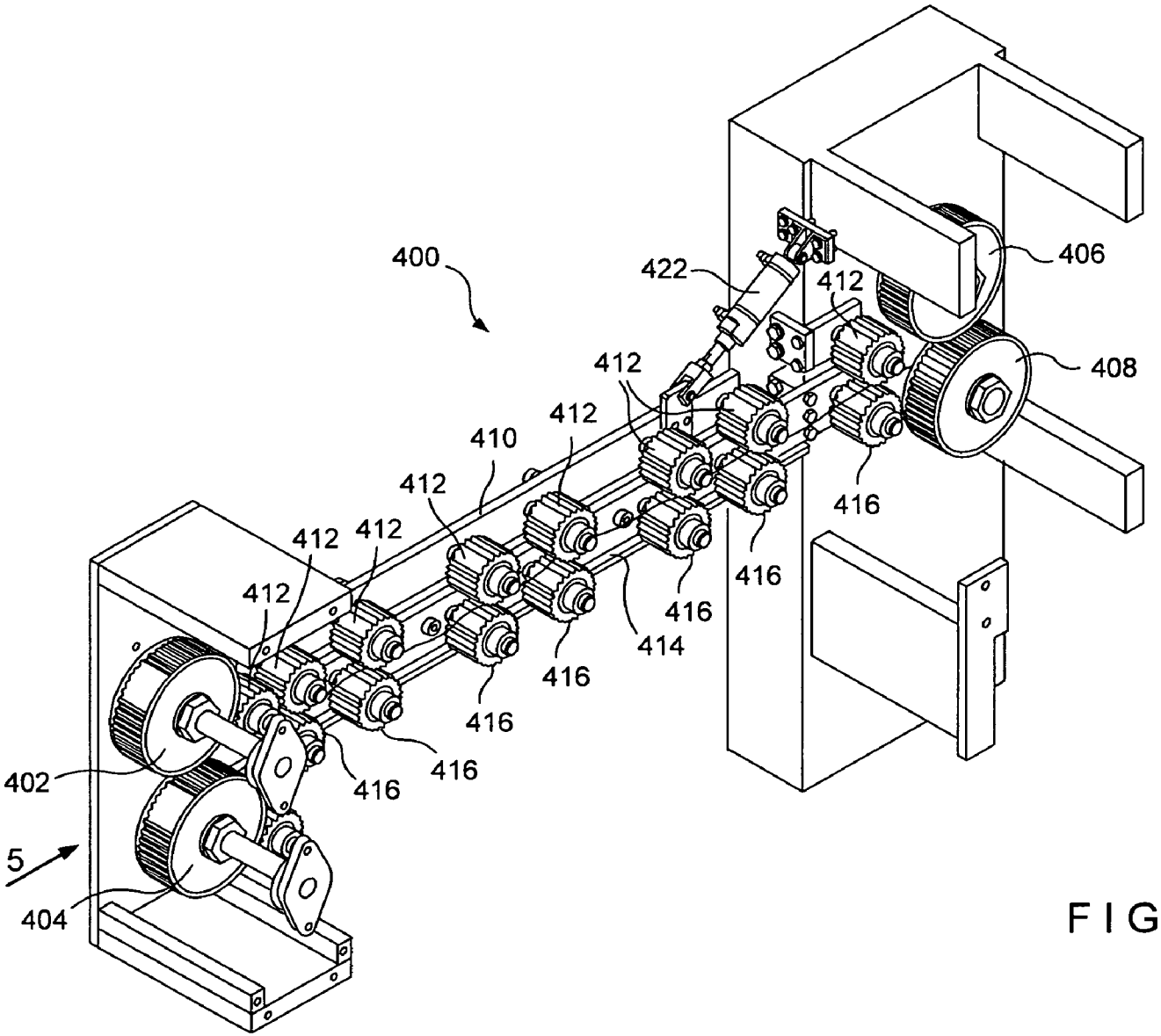
FIG. 4 is a perspective view of the driven-belt apparatus, with the belt shown partially in phantom, for urging the zipper flanges against the exterior of the horizontally oriented reclosable packages, in order to assure the quality of the seal by the hot-melt adhesive therebetween.
Figure 5:
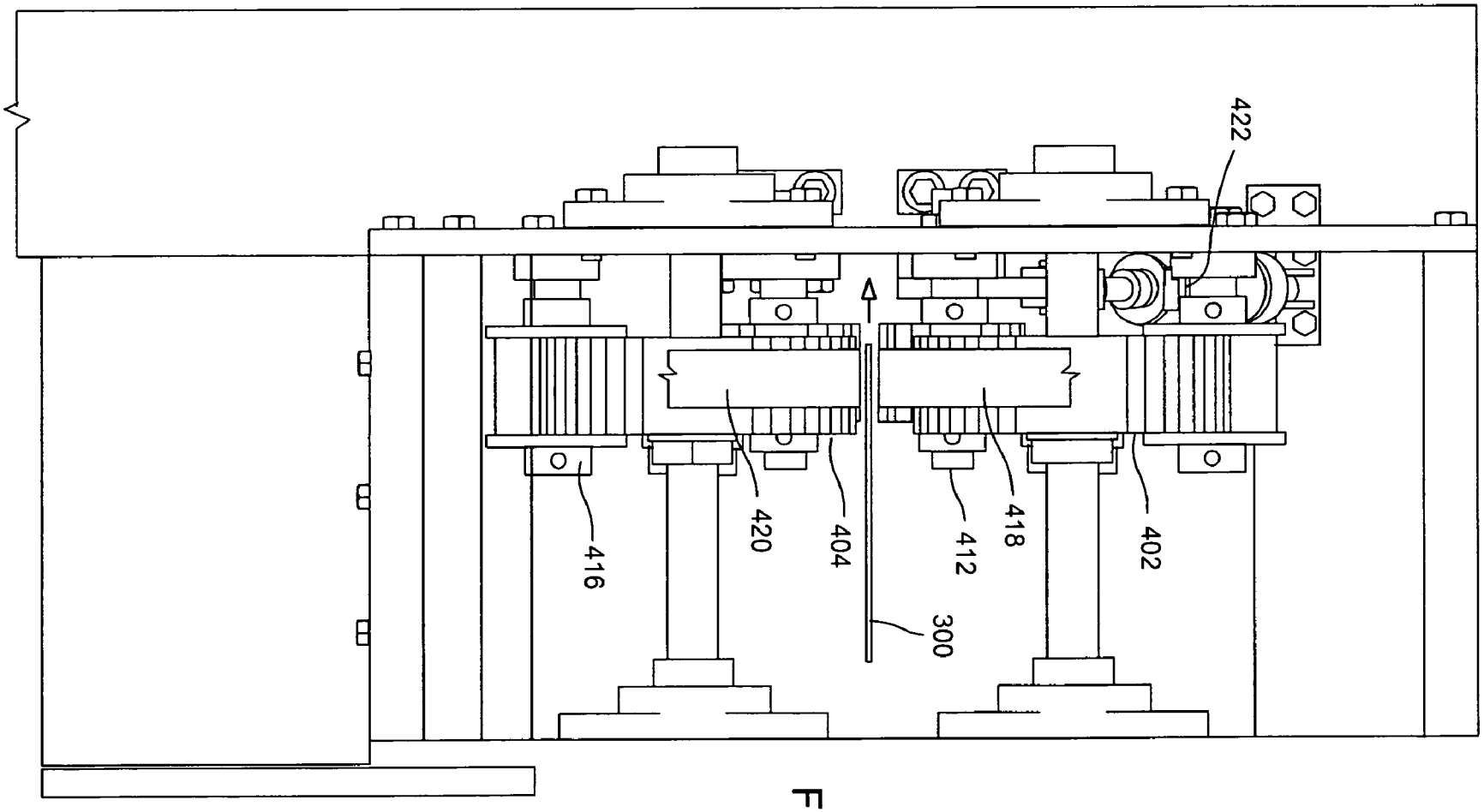
FIG. 5 is a cross-sectional view along plane 5-5 of FIG. 4.

Zipper 100, along with the packages or bags 300 attached thereto, continues to move in the machine direction at the selected velocity so that first and second flanges 106, 108, with edge 302 of package or bag 300 captured therebetween, is introduced to driven-belt apparatus 400 which is illustrated, in part, in the upper right hand corner of FIG. 1, the upper central portions of FIGS. 2 and 3, and in further detail in FIGS. 4 and 5.

Driven-belt apparatus 400 includes upper and lower forward opposed rollers 402, 404 and upper and lower rearward opposed rollers 406, 408. Driven-belt apparatus 400 further includes wedge guides 401 (see FIGS. 1-3) on both the upper and lower portions thereof to urge first and second zipper flanges 106, 108 into position against package 300. At least one of four opposed rollers 402, 404, 406, 408 is powered, but typically one roller in the pair 402, 404 and another roller in the pair 406, 408 are powered. An upper bar 410 with upper idler rollers 412 is provided and a lower bar 414 with lower idler rollers 416 is likewise provided. Upper belt 418 passes around upper forward opposed roller 402 and upper rearward opposed roller 406, with the lower portion of upper belt 418 being immediately below upper idler rollers 412. Lower belt 420 passes around lower forward opposed roller 404 and lower rearward opposed roller 408, with the upper portion of lower belt 420 passing immediately above lower idler rollers 416. Upper and lower belts 418, 420 are shown only partially and in phantom in FIG. 4. However, belts 418, 420 are shown in the cross-section view of FIG. 5.

Piston arrangement 422, shown in FIG. 4, allows upper bar 410 to be moved upwardly away from lower bar 412 as required for maintenance, and lowered so as to form the desired nip between upper and lower belts 418, 420. The nip between upper and lower belts 418, 420, into which the zipper 100 with edge 302 of package 300 enters between the upper and lower opposed rollers 402, 404, creates highly desirable and uniform surface contact among the first and second zipper flanges 106, 108, the hot-melt adhesive and the walls of package or bag 300 thereby creating an adhesive connection or bond between the flanges and the package or bag walls which is highly consistent, reliable and strong. The driving of upper and lower belts 418, 420 further moves the packages or bags 300 with the attached zipper 100 in the machine direction. Zipper 100 is subsequently separated between subsequent packages 300 thereby resulting in a plurality of individual packages.

It is envisioned that this apparatus is particularly well-adapted for continuous operation (that is, typically without the need for intermittent movement) through a range of operating speeds.

Thus the several aforementioned objects and advantages are most effectively attained. Although preferred embodiments of the invention have been disclosed and described in detail herein, it should be understood that this invention is in no sense limited thereby and its scope is to be determined by that of the appended claims.

What is claimed is:

1. A method of manufacturing reclosable packages including the steps of:

providing a length of zipper material including first and second profiles, including respective first and second flanges;

spreading the first and second flanges apart whereby selected walls of the first and second flanges face upwardly;

after the spreading step, passing the first and second flanges under an adhesive dispenser while maintaining the first and second flanges apart from the spreading step, and dispensing adhesive onto the selected walls of the first and second flanges; and after the passing step, positioning a series of sequential horizontally-oriented packages proximate to the length of zipper material while maintaining the first and second flanges apart from the spreading step, wherein the series of sequential horizontally-oriented packages move at a speed and a machine direction equal to those of the length of zipper material;

after the positioning step, urging the first and second flanges, which have been maintained apart since the spreading step, toward each other thereby capturing edges of sequential horizontally-oriented packages and securing the first and second flanges to walls of sequential packages, wherein the step of urging the first and second flanges toward each other is performed by a tube with a longitudinal slit, wherein interlocking elements of the first and second zipper profiles pass through an interior of the tube and the first and second flanges extend though the longitudinal slit; and pressing the first and second flanges together, with the edge of the reclosable package and the adhesive therebetween.

2. The method of manufacturing reclosable packages of claim 1 wherein the step of dispensing adhesive directs the adhesive in a downward direction.

3. The method of manufacturing reclosable packages of claim 2 wherein the adhesive is a hot-melt adhesive.

4. The method of manufacturing reclosable packages of claim 2 wherein the adhesive is a hot-melt cross-linkable adhesive.

5. The method of manufacturing reclosable packages of claim 2 wherein the adhesive is hot-melt cross-linkable polyurethane reactive adhesive.

6. The method of manufacturing reclosable packages of claim 3 wherein the length of zipper material is provided in a spool.

7. The method of manufacturing reclosable packages of claim 3 wherein the selected walls of the first and second flanges are the inner walls of the respective first and second flanges.

8. The method of manufacturing reclosable packages of claim 3 wherein the first and second profiles include respective first and second interlocking elements which remain interlocked with each other during the step of passing the first and second flanges under an adhesive dispenser.

9. The method of manufacturing reclosable packages of claim 7 wherein the step of spreading the first and second flanges is performed by first and second roller mechanisms engaging the respective first and second flanges.

10. The method of manufacturing reclosable packages of claim 9 wherein the first roller mechanism is a first pair of opposed rollers and the second roller mechanism is a second pair of opposed rollers.

11. The method of manufacturing reclosable packages of claim 9 wherein the step of spreading the first and second flanges spreads the first and second flanges substantially 180 degrees from each other.

12. The method of manufacturing reclosable packages of claim 9 wherein the step of securing the first and second flanges to walls of sequential packages includes securing the interior walls of the first and second flanges to the exterior of walls of sequential packages.

13. The method of manufacturing reclosable packages of claim 12 wherein the first and second zipper flanges extend toward the series of sequential horizontally-oriented packages when the first and second zipper flanges extend through the longitudinal slit.

14. The method of manufacturing reclosable packages of claim 13 wherein the step of pressing is performed by first and second opposed belts.

15. The method of manufacturing reclosable packages of claim 14 wherein the first and second opposed belts traverse paths defined, in part, by respective first and second rows of idler wheels.

16. The method of manufacturing reclosable packages of claim 1 wherein walls of the sequential packages are woven polypropylene.

* * * * *